US009803297B2

(12) United States Patent
Glawion et al.

(10) Patent No.: US 9,803,297 B2
(45) Date of Patent: Oct. 31, 2017

(54) DEVICE FOR GUIDING FIBRE TOWS THROUGH OXIDATION FURNACES

(71) Applicant: OERLIKON TEXTILE GMBH & CO. KG, Remscheid (DE)

(72) Inventors: Erwin Glawion, Groβostheim (DE); Rolf Schröder, Langen (DE); Christian Knörzer, Langen (DE)

(73) Assignee: OERLIKON TEXTILE GMBH & CO. KG, Remscheid (DE)

( * ) Notice: Subject to any disclaimer, the term of this patent is extended or adjusted under 35 U.S.C. 154(b) by 0 days.

(21) Appl. No.: 14/440,806

(22) PCT Filed: Jul. 5, 2013

(86) PCT No.: PCT/EP2013/001980

§ 371 (c)(1),
(2) Date: May 5, 2015

(87) PCT Pub. No.: WO2014/067592

PCT Pub. Date: May 8, 2014

(65) Prior Publication Data

US 2015/0299910 A1 Oct. 22, 2015

(30) Foreign Application Priority Data

Nov. 5, 2012 (DE) ..... 10 2012 110 582

(51) Int. Cl.
*B65H 51/26* (2006.01)
*D01F 9/32* (2006.01)
(Continued)

(52) U.S. Cl.
CPC ..... *D01F 9/32* (2013.01); *B65H 51/12* (2013.01); *B65H 57/14* (2013.01);
(Continued)

(58) Field of Classification Search
CPC ..... B65H 51/04; B65H 51/06; B65H 51/12; B65H 51/26; B65H 57/14; B65H 2402/51;
(Continued)

(56) References Cited

U.S. PATENT DOCUMENTS 2,817,940 A * 12/1957 Lorig ..... B65G 39/071 226/192
2,896,572 A * 7/1959 Burke ..... C23C 2/36 118/235
(Continued)

FOREIGN PATENT DOCUMENTS

| | | | |
|---|---|---|---|
| EP | 0111416 | A2 | 6/1984 |
| GB | 1280850 | A | 7/1972 |
| JP | H082820 | A | 1/1996 |

OTHER PUBLICATIONS

International Search Report for International Application No. PCT/EP2013/001980 dated Oct. 25, 2013.

*Primary Examiner* — Michael McCullough
(74) *Attorney, Agent, or Firm* — FisherBroyles, LLP; Robert Kinberg

(57) ABSTRACT

The invention relates to an apparatus for passing at least one fiber tow multiple times through an oxidation furnace by means of godets, the at least one fiber tow being diverted via at least one godet that is arranged offset. According to the invention, the godet comprises a shaft on which at least two single rollers are arranged to be mounted, each single roller being arranged so as to be rotatable on the shaft.

6 Claims, 2 Drawing Sheets

Figure 1:
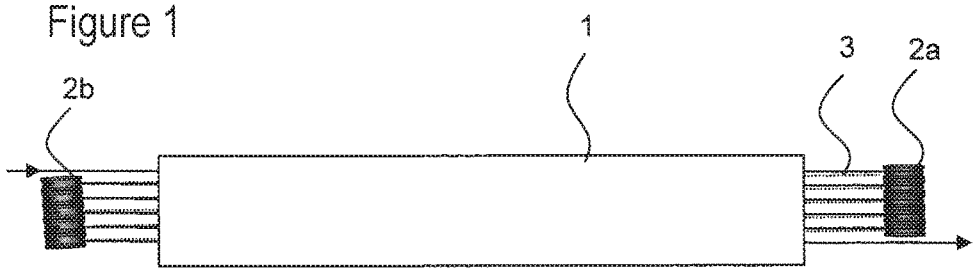

(51) Int. Cl.

| | |
|---|---|
| ***F27B 9/28*** | (2006.01) |
| ***B65H 57/14*** | (2006.01) |
| ***F27B 5/04*** | (2006.01) |
| ***B65H 51/12*** | (2006.01) |
| ***D01D 10/04*** | (2006.01) |
| *F27D 3/00* | (2006.01) |

(52) U.S. Cl.
CPC ..... *D01D 10/0445* (2013.01); *F27B 5/04* (2013.01); *F27B 9/28* (2013.01); *F27D 2003/0042* (2013.01); *F27D 2003/0067* (2013.01)

(58) Field of Classification Search
CPC ..... B65H 2402/62; B65H 2404/13; B65H 2404/131; B65H 2404/1313; B65H 2404/1314; B65H 2404/1315; B65H 2404/1316; B65H 2404/132; B65H 2404/1321; B65H 2404/13211; B65H 2404/13212; B65H 2404/133; D01D 10/0445; D01F 9/32
See application file for complete search history.

(56) References Cited

U.S. PATENT DOCUMENTS

| | | | |
|---|---|---|---|
| 3,552,923 | A | 1/1971 | Carenter et al. |
| 2008/0118427 | A1 | 5/2008 | Leon Y Leon |

* cited by examiner

DEVICE FOR GUIDING FIBRE TOWS THROUGH OXIDATION FURNACES

The invention relates to an apparatus for passing at least one fibre tow multiple times through an oxidation furnace by means of godets, the at least one fibre tow being diverted via at least one godet that is arranged offset.

For the production of carbon fibres, previously spun polyacrylic fibres are combined to form fibre tows which, in a second process step, need first to be stabilised and oxidised before they can be carbonised at temperatures above 1000° C. This treatment must be carried out with very great care, because conversion of the fibres involves an exothermic process. The conversion is initiated by supplying heat in the form of warm air, the warm air simultaneously being used for dissipating heat of reaction. Supplying heat too rapidly would result in an excessive reaction if the resulting exothermic heat can no longer be dissipated. This would ultimately lead to an uncontrollable chain reaction with spontaneous ignition, wherein toxic vapours would be formed and the fibres would become unusable. Such conversion therefore requires a period of about 60-90 minutes, during which time the fibre tows are advantageously guided through the furnace(s) continuously with a defined tension, it being necessary to avoid the formation of accumulations of fibre, such as crossings, knots or bunchings of a plurality of fibre tows, because this would render the controlled dissipation of heat more difficult.

In accordance with the production speed, the lengths being treated are enormous and cannot be realised economically with a single straight pass through the furnace. For that reason the furnaces in production plants have a plurality of openings in order that the tows can be guided through the furnace in question in parallel with one another and along a meandering path. Diverting rollers are provided on the outside because, on the one hand, temperature-resistant bearings are expensive and, on the other hand, the plant operative needs to have easy access in the event of lap formation caused by filament breakages.

Such diverting rollers are freely rotatable and are moved by the fibre tows. The fibre tows in turn are drawn by a drawing mechanism after the furnace, a drawing mechanism before the furnace acting as a braking device in order to establish the fibre tension required for the process. The heating of the fibre tows typically results in substantial shrinkage which, without equalisation of the tension, would result in a rise in tension and fibre breakages. For that reason, before the subsequent drawing mechanism there are usually provided tension-measuring rolls which then generate a signal for adjusting the drawing mechanism speed. The transmission of tension or the equalisation in the course of the multiple passes through the furnace is effected by means of the freely rotatable diverting rollers.

It is usual for production plants to operate with several hundred fibre tows and at production speeds of 4-10 m/min. This results in furnace sizes similar to two-story houses with overall heights of up to 10 m. If, however, for development purposes only a single fibre tow or a small number of fibre tows are to be produced, the production speed must be significantly reduced in order that the length being treated and accordingly the resulting furnace size is suitable for typical room sizes in institutes or development centres. A meandering arrangement as in the case of production plants would, however, always result in an extremely large and correspondingly expensive oxidation furnace.

Pairs of godets, by means of which fibre tows are guided multiple times via two godets that are arranged slightly offset, are known from fibre manufacture. They are shown, for example, in FIG. 49, page 119, of the book "Synthesefasern" ["*Synthetic fibres*"] by Béla von Falkai, published in 1981 by Verlag Chemie. In the case of offset godets, a filament in each case seeks to run perpendicularly on the opposite godet, resulting in a certain amount of displacement. Consequently, the displacement can be adjusted by means of the relative angular position. This is also possible for a plurality of fibre tows simultaneously.

Multiple wraps result in an increase in frictional forces or in a reduction in slippage. If the distance between the two rolls that are arranged offset is sufficiently large, an oxidation furnace can be placed between them and the filaments can pass through the furnaces multiple times on the outward and return journeys. What is not solved in the case of single godets, however, is the compensation of fibre shrinkage, because the filaments are retained on the two rollers by frictional adhesion and no equalisation of tension between the individual passes would take place, thus resulting in fibre breakages in regions of high fibre shrinkage.

The problem of the invention is to provide an apparatus for passing a fibre tow multiple times through an oxidation furnace with simultaneous equalisation of tension.

The invention solves that problem by the teaching according to claim 1; further advantageous structural features of the invention are characterised by the subsidiary claims.

In accordance with the technical teaching according to claim 1, the apparatus for passing at least one fibre tow multiple times through an oxidation furnace comprises godets, the at least one fibre tow being diverted via at least one godet that is arranged offset. Due to the fact that the godet comprises a shaft on which at least two single rollers are arranged to be mounted, each single roller being arranged so as to be rotatable on the shaft, multiple passes through the oxidation furnace are possible, with equalisation of the tension of the fibre tow being achieved at the same time.

According to the invention it is possible for a godet that is arranged offset to be arranged on both sides of the oxidation furnace or only on one side. Due to the fact that the fibre tows are no longer guided around the godets by means of friction, but are guided by the rotatably arranged single roller, the tensions in the fibre tow are reduced. According to the prior art, the fibre tows are diverted via a common rotatable godet, with the result that some of the fibre tows slide with friction on the godet, because the fibre tows have different drafts and tensions. According to the invention, the tensions can be reduced by guiding and diverting the fibre tow by means of a separate single roller on each diversion on a godet.

Each of these single rollers can preferably have a rolling bearing, ball bearing or sliding-contact bearing (not shown) to minimise frictional resistances.

In a preferred embodiment, each single roller has a shoulder at least in the region of an end face. This ensures guidance of the fibre tow on a single roller.

In an advantageous arrangement, the single roller has a depression in the region of the end face having the shoulder, into which depression the end face of a further single roller is able to fit. This avoids the possibility of the fibre tow's becoming jammed between the single rollers.

A further improvement can be achieved if the end face that fits into the depression likewise has a shoulder. This likewise increases the protection of the fibre tow against jamming in the gap between the single rollers.

Centering of the single rollers relative to one another can be achieved by the depression's having a conical or concave contour.

For that purpose, the end face of the single roller that fits into the depression has a conical or convex contour complementary to the depression.

As a result of the different configurations of the shoulders arranged on the end faces, which shoulders preferably have different heights, the end face having the small shoulder is able to fit into the depression on the end face having the large shoulder, resulting in sleeve-like coverage that prevents the fibre tow from slipping into the gap between the single rollers.

In a preferred embodiment, the shafts are mounted in a holding means, the angular position of the shafts being adjustable by means of the holding means. This enables the angle of inclination and therefore the diversion of the fibre tow through the oxidation furnace to be adjusted.

Mounting the fibre tow after tow breakage or after a plant refit can be made significantly easier by one-ended mounting of the shafts.

Figure 2:
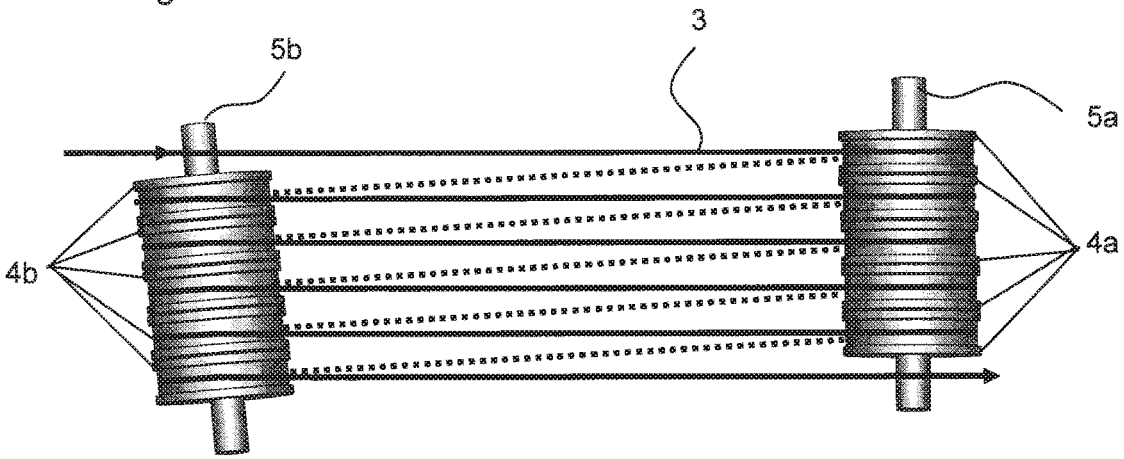
Figure 3:
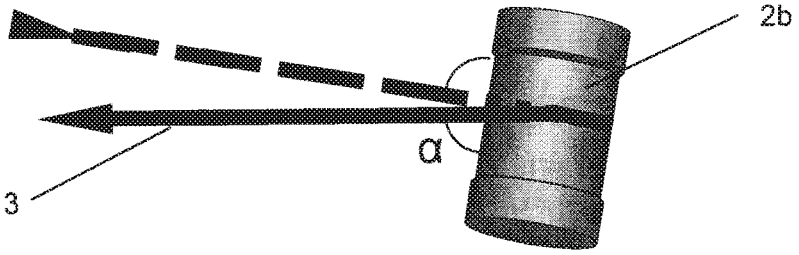
Figure 4:
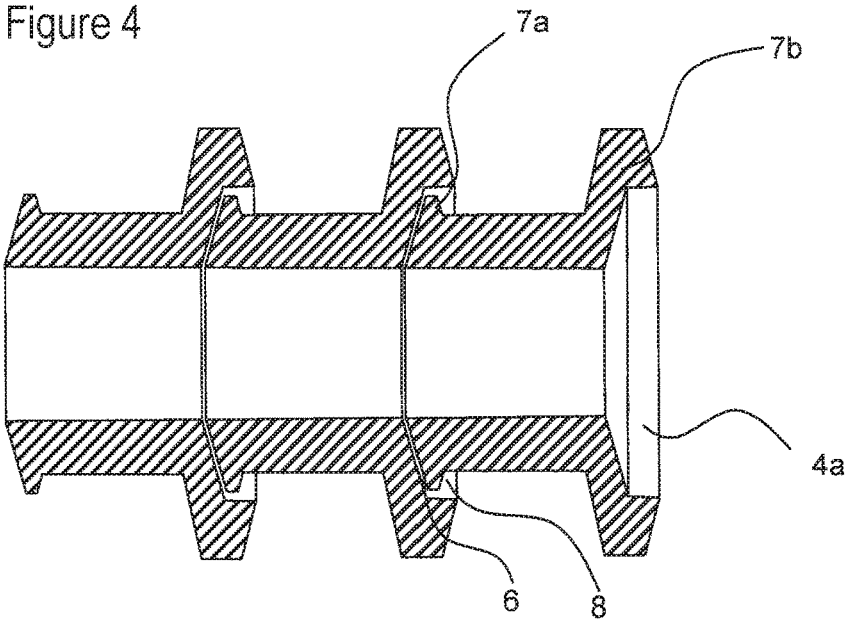
Figure 5:
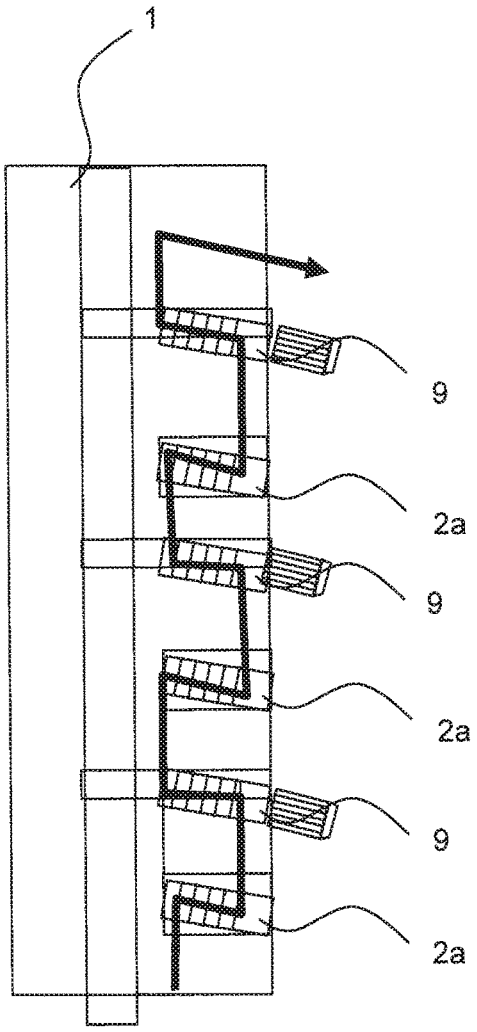

The invention is described in greater detail below with reference to a possible exemplary embodiment which is shown diagrammatically in the drawings, wherein FIG. 1: is a diagrammatic plan view of an oxidation furnace having godets on both sides;

FIG. 2: shows a pair of godets according to the invention without the oxidation furnace;

FIG. 3: is a detail view of the rollers or godets;

FIG. 4: is a partial section through a godet having single rollers;

FIG. 5: shows the godets according to the invention used as a drawing mechanism.

FIG. 1 is a diagrammatic plan view of an oxidation furnace 1 having godets 2*a*, 2*b* on both sides and the fibre tow 3 running thereon. The fibre tow 3, coming from the left, is supplied to the oxidation furnace 1 and, after a plurality of passes, leaves the oxidation furnace 1 displaced horizontally on the right-hand side. It is also possible, however, for the fibre tow 3 to leave the oxidation furnace 1 on the left-hand side if this is required by the process or the local conditions.

FIG. 2 again shows a pair of godets 2*a*, 2*b* with a fibre tow 3. Each godet 2*a*, 2*b* consists of at least two single rollers 4*a*, 4*b* which are arranged to be mounted on shafts 5*a* and 5*b*. In this exemplary embodiment five single rollers 4*a*, 4*b* are mounted on each shaft 5*a*, 5*b*. Depending upon the dimensions of the oxidation furnace 1 it is also possible to arrange a smaller or larger number of single rollers 4*a*, 4*b* on shafts 5*a*, 5*b*.

The shafts 5*a*, 5*b* are fixed in a holding means (not shown) at both ends but can also be mounted only at one end. The holding means are arranged to be displaceable, so that the angular position necessary for the desired displacement can be adjusted. For better understanding, the upper filament run, where the fibre tow 3 runs from left to right, is shown as a solid line, and the lower filament run, where the fibre tow 3 runs from right to left, is shown as a dotted line.

The physical principle for the displacement of the fibre tow 3 is illustrated in FIG. 3. As a result of the transverse forces that occur, a filament or a fibre tow 3 always seeks to run onto a rotating roller or godet 2*b* perpendicularly at an angle of 90°. The actual change in the direction of fibre travel takes place where the filament or fibre tow 3 runs off the roller, when the frictional forces between the fibre tow 3 and the surface of the roller are no longer sufficient to offer resistance to the axial transverse forces. The fibre tow 3 then slips until the fibre tow 3, which was previously running radially over the roller, forms a straight line at an angle perpendicular to the roller located opposite.

To provide support during set-up and adjustment of the godets 2*a*, 2*b*, the single rollers 4*a*, 4*b* have a large shoulder 7*b* in the region of a first end face and a small shoulder 7*a* in the region of the second end face. The single roller 4*a*, 4*b* has, in the region of the first end face on which the large shoulder 7*b* is arranged, a depression 8 into which the small shoulder 7*a* is able to fit. This prevents the fibre tow 3 from slipping into the gap 6 between two single rollers 4*a* and becoming jammed therein.

The large shoulder 7*b* therefore covers the small shoulder 7*a* of the adjacent single roller 4*a*, 4*b* like a sleeve. Self-centering is achieved by the second end face of the single roller 4*a*, 4*b*, which has the small shoulder 7*a*, having a conical or convex contour. Complementary thereto, the depression 8 on the first end face having the large shoulder 7*b* is likewise of conical or concave construction.

It will be understood that, depending upon the desired number of passes through the oxidation furnace 1, the single rollers 4*a*, 4*b* are exchangeable and have different widths. The single rollers 4*a*, 4*b* used will logically always have a width a multiple of which corresponds to the total width of the oxidation furnace 1 or the width of a godet 2*a*, 2*b*.

In order to equalise the horizontal displacement resulting from the wrapping, it is possible to use drawing mechanisms 9 likewise in the form of godets which, as shown in FIG. 5, are directed towards the rear. As a result, the fibre tow 3 is guided towards the rear again, with the elegant result that, in the case of a plurality of oxidation furnaces 1 arranged one after the other, the oxidation furnaces 1 are aligned in a row, which significantly facilitates operation and maintenance.

REFERENCE NUMERALS

1 oxidation furnace
2*a*, 2*b* godets
3 fibre tow
4*a*, 4*b* single roller
5*a*, 5*b* shaft
6 gap
7*a* small shoulder
7*b* large shoulder
8 depression
9 drawing mechanism

The invention claimed is:

1. An apparatus for passing at least one fiber tow multiple times through an oxidation furnace, comprising: at least a first and at least a second godet arranged opposite to each other, the at least first godet comprising a first shaft and the at least second godet comprising a second shaft, wherein the first shaft is arranged angularly offset relative to the second shaft so that the at least one fiber tow is diverted by the at least first godet, wherein at least the first shaft is a straight shaft, wherein the at least first godet further comprises at least two single rollers arranged rotatable on the first straight shaft; wherein each of the at least two single rollers has a first end face and a first shoulder at least in a region of the first end face; wherein at least one of the two single rollers has a depression in the region of the first end face having the first shoulder, into which depression a second end face of another one of the at least two single rollers is received.

2. The apparatus according to claim 1, wherein the second end face has a second shoulder.

3. The apparatus according to claim 2, wherein the first and second shoulders are differently configured.

4. The apparatus according to claim 1, wherein the depression has one of a conical or concave contour.

5. The apparatus according to claim 1, wherein the second end face of said another one of the at least two single rollers has one of a conical or convex contour complementary to the depression.

6. The apparatus according to claim 1, wherein each of the single rollers is mountable on the shaft with a bearing.

* * * * *